United States Patent [19]

Rassieur et al.

[11] Patent Number: 4,854,395

[45] Date of Patent: Aug. 8, 1989

[54] HYDRAULIC KELLY BAR CHUCK

[75] Inventors: Charles L. Rassieur, St. Louis County, Mo.; Raymond W. Burns, Madison County, Ill.

[73] Assignee: Central Mine Equipment Company, St. Louis, Mo.

[21] Appl. No.: 207,392

[22] Filed: Jun. 16, 1988

[51] Int. Cl.[4] ..... E21B 3/04

[52] U.S. Cl. ..... 173/163; 173/152; 279/4

[58] Field of Search ..... 173/163–166, 173/152; 175/195; 279/4

[56] References Cited

U.S. PATENT DOCUMENTS

| | | | |
|---|---|---|---|
| 1,809,444 | 6/1931 | Greve | 173/164 |
| 3,561,545 | 2/1971 | Rassieur | 173/166 |
| 4,393,945 | 7/1983 | Rassieur | 173/163 |

*Primary Examiner*—Frank T. Yost
*Assistant Examiner*—James L. Wolfe
*Attorney, Agent, or Firm*—Polster, Polster & Lucchesi

[57] ABSTRACT

In a rotary drill having a driven rotary table with an axially directed passage through its center of rotation defined by a hollow spindle, a kelly bar extending through the passage, and a chuck mounted on the spindle, plungers are mounted in cylinders in the chuck for radial movement into and out of engagement with shoulders on the kelly bar. A housing surrounds a portion of the chuck. The housing is held against rotation and has a fluid passage through it communicating with an annular manifold channel. Fluid passages in the chuck, associated with each cylinder, communicate at one end with the manifold channel and at another end with the cylinder radially inboard of a piston part of the plunger. Oil under pressure to move the plungers out is caused to leak into bearings positioned axially above and below the manifold, to lubricate, flush and cool them. The plunger has a nose with a depending lip that engages an upper or lower shoulder of the kelly bar when the chuck is forced up or down to drive the kelly bar upwardly or downwardly.

14 Claims, 3 Drawing Sheets

HYDRAULIC KELLY BAR CHUCK

BACKGROUND OF THE INVENTION

The hydraulic chuck of this invention is an improvement upon the device shown and described in U.S. Pat. No. 4,393,945. In the device of that patent, a housing is mounted on a spindle rotated by a rotary table, the housing being held against rotation with the spindle, but being free to move axially with the table. A hollow chuck body is fixedly mounted on the spindle, for rotation therewith. A tube mounted on the chuck body has fingers extending axially to cam plungers out of engagement with a kelly bar extending through the spindle. The device has worked well, but it requires a substantial number of parts, the use of O-rings, and sealed bearings that can not easily be relubricated.

One of the objects of the invention is to provide a hydraulic kelly bar chuck that requires fewer parts than the device of U.S. Pat. No. 4,393,945, but operates as effectively.

Another object is to provide such a chuck in which bearings are cooled and lubricated by hydraulic fluid used to operate the chuck plungers.

Yet another object is to provide such a chuck in which a visual indication is given of the withdrawal of the plungers from engagement with the kelly bar.

Still another object is to provide a construction of plungers that minimizes wear and tends to insure engagement with the kelly bar in the course of forcing the kelly bar downward.

Other objects of this invention will be apparent to those skilled in the art in light of the following description and accompanying drawings.

SUMMARY OF THE INVENTION

In accordance with this invention, generally stated, in a rotary drilling apparatus wherein a rotary table is adapted to be moved axially while rotating, the rotary table including a spindle having an axially directed passage through its center of rotation, a kelly bar extending through the passage, the kelly bar having channel-defining shoulder surfaces. A chuck body is mounted on the spindle for rotation with the spindle. Elongated plungers mounted in the chuck body are movable radially with respect to the spindle passage for selectively engaging and disengaging the kelly bar shoulder surfaces. A housing is provided, surrounding a part of the chuck body. The housing is restrained against rotation with the spindle and chuck body. The plungers are mounted in cylinders in the chuck body, and are each provided with a nose that engages shoulders in the kelly bar, an intermediate cylindrical portion and an enlarged annular piston part radially outward of the intermediate portion. The cylinder in the spindle in which each plunger reciprocates has a configuration complementary to the plunger intermediate portion and piston part to receive them closely but slidably. The housing has a fluid passage through it communicating with an annular manifold channel in the chuck body, and the chuck body has fluid passages associated with each cylinder, communicating at one end with the manifold channel and at another end with the cylinder radially inboard of the piston part. The nose of the plunger has upper and lower chordal flats parallel with one another at their leading edges, which are parallel with the kelly bar shoulders. The lower chordal flat is inclined downwardly in a direction toward the shoulders to define a depending lip that engages the lower shoulder. Means are provided for preventing rotation of the plungers, so as to maintain the nose flats in the proper orientation. Bearings, extending circumferentially around the chuck body, between the chuck body and the housing, are spaced axially above and below the annular manifold channel. Annular seals above and below the manifold channel between the manifold channel and the bearings are designed to leak sufficient of the hydraulic fluid under pressure to lubricate, flush and cool both the bearings and the seals themselves. Drain passages in the housing permit the hydraulic fluid to flow through the bearings and back to a reservoir. Preferably, the flow of fluid through the seals and bearings is on the order of one half gallon per minute at 300 pounds pressure. Preferably the plungers are biased into engagement with the kelly bar shoulders by helical compression springs, and preferably those springs bottom on their radially inward ends on a disc to which a stem is connected that extends radially outwardly through a hole in a cap covering a radially outer, open, end of the cylinder in which the plunger slides. In this way, when the plunger is retracted, the stem protrudes from the housing and can readily be seen. Preferably, also, the lower kelly bar shoulder at each level is sloped downwardly radially inwardly, complementarily to the slope of the lower flat on the plunger nose, so as to tend to cam the plunger inwardly when downward pressure is put on the chuck, hence the kelly bar. Even if this is not done, the slope of the plunger flat serves to lengthen the effective life of the plunger nose. If the nose is straight, wear on the nose tends to produce a chamfer or radius on both the nose and the kelly bar shoulder on which it bears downwardly, which tends to cam the plunger outwardly rather than inwardly.

DESCRIPTION OF THE PREFERRED EMBODIMENT

Figure 1:
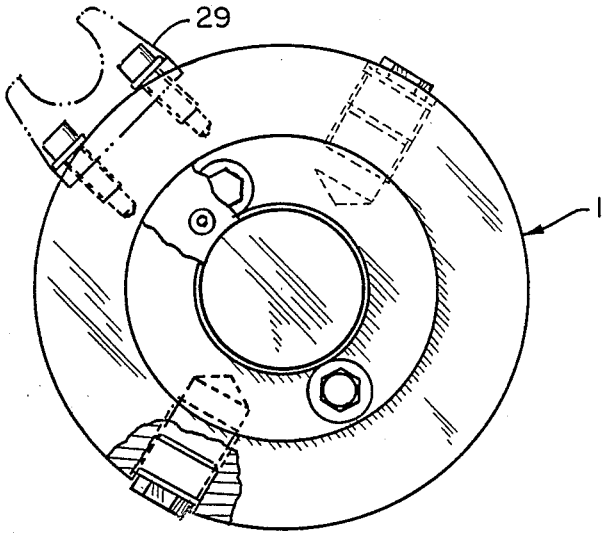
FIG. 1 is a top plan view, partly broken away and partly in section, of one illustrative embodiment of hydraulic kelly bar chuck of this invention.
Figure 2:
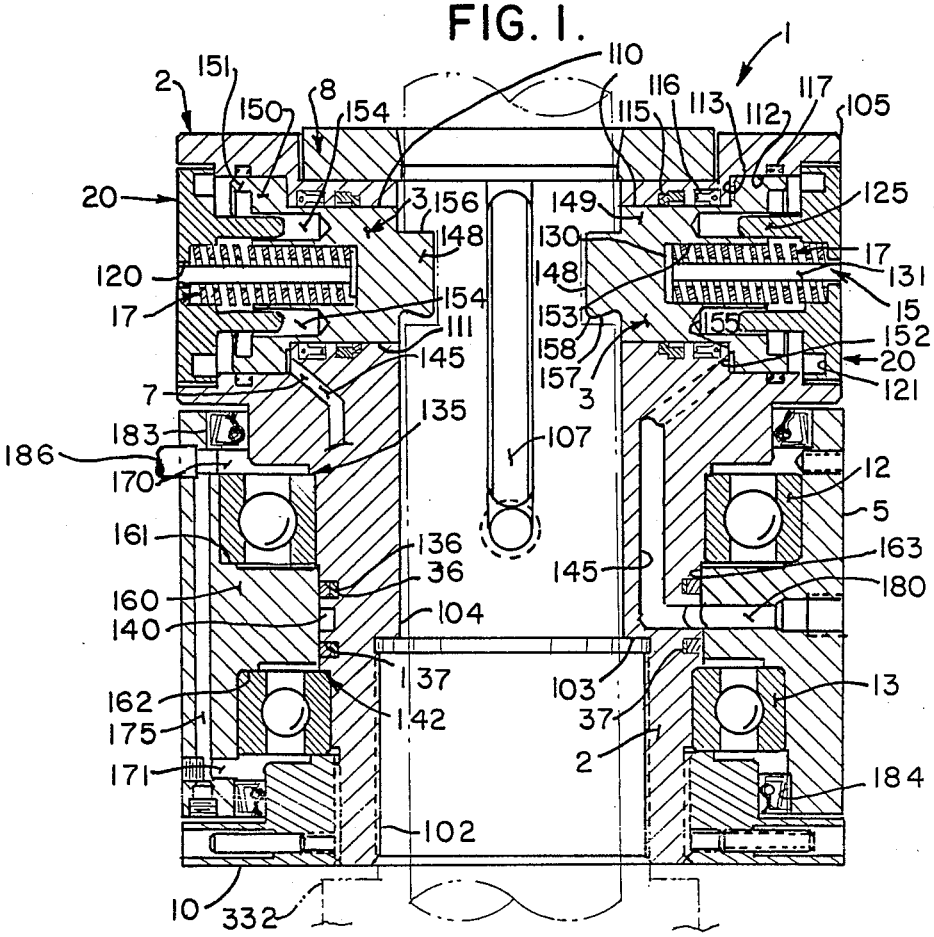
FIG. 2 is a diametric sectional view.
Figure 9:
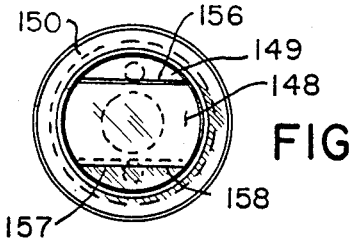
FIG. 9 is an elevational view in a radially outward direction of a plunger part of the chuck shown in FIGS. 1–3.

Referring now to the drawing and particularly to FIGS. 1 through 3 and 10 for one illustrative embodiment of hydraulic kelly bar chuck of this invention, reference numeral 1 indicates the assembled chuck. The chuck 1 is mounted on a spindle of a rotary table 300, supported by a yoke 335 mounted on a pair of slide tubes 336, slidably mounted on a pair of hydraulic cylinders 337 for vertical motion thereon, as illustrated and described in U.S. Pat. Nos. 3,561,545 and, more particularly, 4,393,945. As in the latter, a pair of support rods or stanchions 339 secured to the yoke transmit the motion of pistons to the yoke. The spindle, as in the device described in U.S. Pat. No. 4,393,945, projects vertically upwardly from the table and has an externally threaded upper section onto which a tubular chuck body 2 is threaded. The chuck body 2 has an axial, cylindrical bore 104, an internally threaded section 102 of which terminates in a shoulder 103.

At its upper end, the chuck body 2 has an axially and radially thick head section 105. The head section 105 is bored and counterbored diametrically to provide, in this embodiment, two plunger receiving cylinders 110. Each of the cylinders has a uniformly cylindrical inner section 111 extending from the bore 104, an enlargedly offset piston receiving section 112, with a shoulder 113 between them, and an open mouth, the edge of which is defined by a chordal flat machined in the outer surface of the head 105 to accept a rectangular cap 20, which is bolted to the head to serve as a closure for the outer end of the cylinder. The cap 20 has a piston skirt-receiving annular channel 121 in it, a stem port 120 concentric with the channel, and a pair of fingers 125 projecting inwardly radially with respect to the bore !04. Wiper 115 and seals 116 and 117 are mounted in annular grooves in the wall of the cylinder defining the inner and piston sections.

At its upper end, the head section 105 is recessed to accept and mount a wear ring 8. Below the head section 105, the outer surface of the body 2 has a circumferential bearing shoulder 135, seal grooves 136 and 137, and, intermediate the seal grooves, an annular manifold channel 140. Below the seal groove 137 the body has a circumferential bearing shoulder 142. The lower end of the outer wall surface of the body 2 is externally threaded to receive an internally threaded bottom closure ring 10.

On diametrically opposite sides, hydraulic fluid passages 145 in the side wall of the chuck body, communicate at one end with the manifold channel !40 and, through an opening in the shoulder 113, with the piston section 112 of the cylinder 110.

The housing 5 has a cylindrical outer surface, and an axially intermediate, radially inwardly extending boss section 160, formed with annular upper and lower bearing shoulders 161 and 162, and a smooth cylindrical inner face 163. The annular boss section 160 defines, with a radial surface and a circumferential surface of the body, upper bearing cavity 170 and, with a radial bearing shoulder and circumferential surface of the body, and radial surfaces of the closure ring 10, a lower bearing cavity 171. An axially extending passage 175 connects the upper part of the cavity 170 and the lower part of the cavity 171, and communicates at its upper end with an internally threaded passage adapted to be connected to a drain conduit 186, also shown schematically in FIG. 8. The lower passages are tapped and plugged. By communicating with the upper end of the passage 175, the drain system ensures that the cavities are filled with oil, even when the rig is not in operation, and because the chuck is fixed against rotation, the drain passage remains uppermost when the feed mechanism is moved to a horizontal transportation position. A radial passage 180 through the housing wall communicates directly with the manifold channel 140 in the housing 5. The radially outer open end of the passage 180 is internally threaded to take a fitting on a pressure line 185, indicated diagrammatically in FIG. 8, from a pressure source 200.

The housing 5 is held against rotation by a retainer 29, bolted securely to the housing, in the same way in which the retainer 29 of the device shown in U.S. Pat. No. 4,393,954 operates.

Ball bearings 12 and 13 are mounted in the cavities 170 and 171 respectively to facilitate the rotation of the chuck body 2 with respect to the housing 5. Low pressure seals 183 and 184 are mounted between the inner wall of the housing, and the outer wall of the chuck body and an outer axially extending wall of the closure ring 10, respectively, to seal the chambers 170 and 171, respectively.

Seals 36 and 37 are seated in the seal grooves 136 and 137 respectively. The seals 36 and 37 are, in this embodiment, Teflon impregnated bronze seals, which ordinarily would not be suitable for high pressure seals under the conditions of rapid rotation to which seals in a chuck of this sort are subjected. However, they are adapted to and intended to leak under pressure, so as to permit a substantial flow of oil through them and into the bearings 12 and 13, thence through the drain line 175 and drain conduit 186, to a reservoir 187. This not only lubricates and flushes the seals and bearings, but cools them as well. The flow can be on the order of a half gallon per minute.

It is not desirable in the present application of the deliberate leakage of oil past the seals to have oil under high pressure in the bearing and outer seal cavities. For example, if oil at about 300 psig is supplied to operate the plungers, the pressure drop across the seals 36 and 37 can be about 295 psig, supplying oil to the bearings and outer seals 183 and 184 at about 5 psig. Such an arrangement can be used in other applications as well, although this particular application has unique advantages because of the conditions under which drilling rigs of this type operate and the speed of rotation (e.g. 600 RPM) and large size of the seals (e.g. on the order of at least six inches, o.d.).

Plungers 3 are slidably mounted in the cylinders 110. The plungers 3 are identical. Each plunger has a nose 148, a cylindrical intermediate portion 149, and an enlarged annular piston part 150. The piston part has a skirt 151 that slides into and out of the channel 121 in the cap 20. Between the cylindrical portion 149 and the piston part 150 is a stepped shoulder with a spacer ledge 155, and a recessed piston head surface 152. The plunger has a central well 153 opening through the end of the plunger opposite the nose 148, and two blind holes 154, diametrically opposite one another outboard of the well 153, into which the fingers 25 of the cap 20 extend.

The nose 148 has an upper chordal flat 156 and a lower chordal flat 157. The radially inward leading edges of the flats 156 and 157 are parallel. However, the flat 157 slopes upwardly in a radially outward direction with respect to the bore 104, to form a depending lip 158. The flats 156 and 157 are maintained in the proper orientation by the fingers 125 of the cap 20 extending into the holes 154.

In this embodiment, an indicating device 15 consists of a disc 130, a radially inner flat surface of which bears against a bottom wall of the well 153, and a stem 131, secured to the opposite face of the disc, projecting radially into the port 120 in the cap 20, in which it is slidably journaled. A helical compression spring 17 bears at one end on the radially outer face of the disc 130, and at its other, on a surface of the cap 20. The spring 17 biases the plunger inwardly. When the plunger is moved radially outwardly, the stem 131 projects from the cap 20, giving visual evidence that the plunger has moved outwardly.

Figure 3:
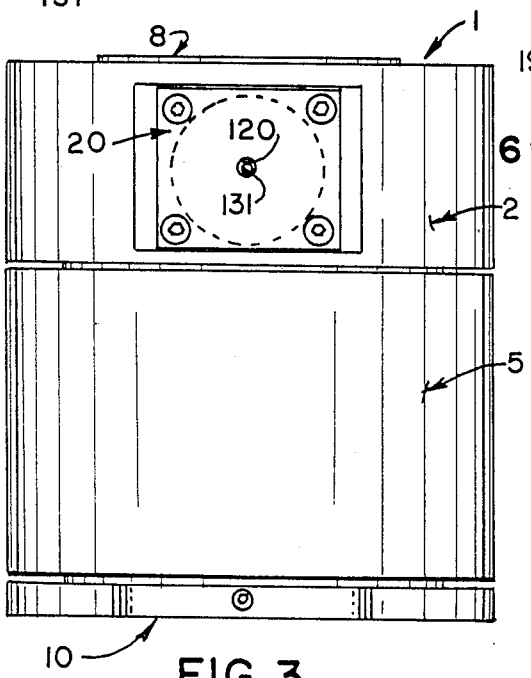
FIG. 3 is a view in side elevation of the chuck.
Figure 4:
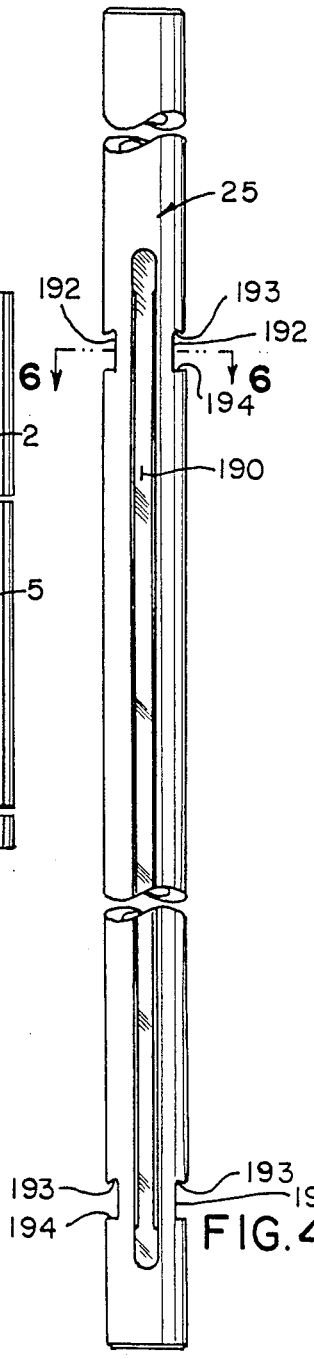
FIG. 4 is a view in side elevation of a fluted kelly bar, inverted with respect to the chuck shown in FIG. 3.
Figure 5:
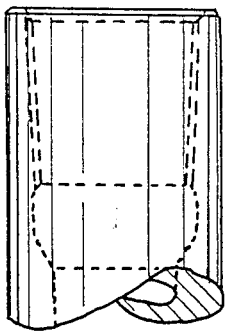
FIG. 5 is a fragmentary view in side elevation of a lower end of the kelly bar.
Figure 6:
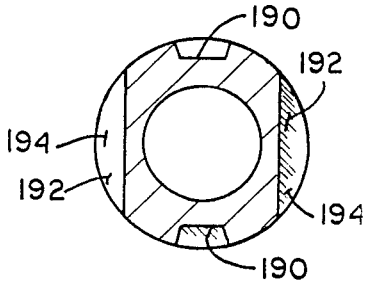
FIG. 6 is a sectional view taken along the line 6—6 of FIG. 4.
Figure 7:
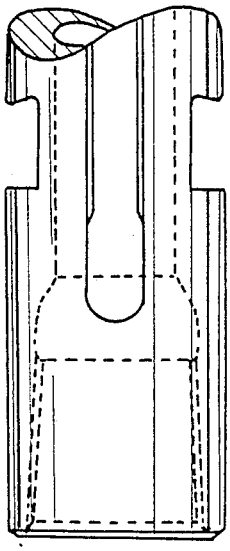
FIG. 7 is a fragmentary view of the upper end of the kelly bar.

Referring now to FIGS. 4 through 7 for one embodiment of fluted kelly bar for use with this invention, the kelly bar 25 is shown in FIGS. 4, 5 and 7 as upside down with respect to the chuck 1 in FIG. 3, but the construction of the kelly bar will be apparent from the drawing. The kelly bar 25 has keyways 190 extending axially of the kelly bar and diametrically opposite one another, as shown in FIGS. 4 and 6, and extending slightly beyond upper and lower channels 192 each defined by a lower shoulder 193 and an upper shoulder 194. There are intermediate channels, not here shown, as described in U.S. Pat. No. 3,561,545. The channels extend chordally of the kelly bar, on diametrically opposite sides, as shown in FIGS. 4 and 6. In the embodiment shown in FIGS. 4–7, the lower shoulder 193 is sloped complementarily to the slope of the lower flat 157. As has been explained above, this construction tends to cam the nose of the plunger radially inwardly, and to avoid the problem of chamfering or rounding of the surface of the plunger engaging the shoulder. However, as has also been explained, the shoulder 193 can be made planar perpendicularly to the axis of the kelly bar, like the shoulder 194, as is conventionally done and as is shown in shadow in FIG. 2, because the lip 158 of the nose of the plunger of this, preferred embodiment of chuck, will still serve a useful function, prolonging the life of the plunger, and inhibiting the formation of chamfers or radii. The kelly bar is prevented from rotation in the chuck by keys 107 held in place in much the same way as the key 30 of the device shown in U.S. Pat. No. 4,393,945. The kelly bar is thus rotated by the chuck body 2 which is rotatably driven by the spindle. This is conventional.

Figure 8:
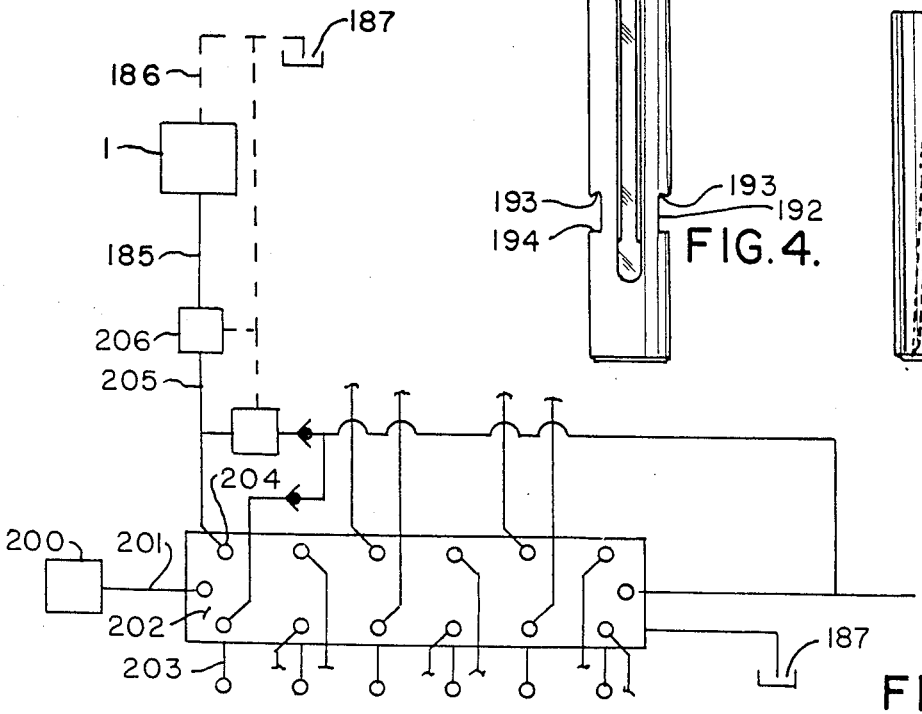
FIG. 8 is a schematic view of a hydraulic fluid supply system.
Figure 10:
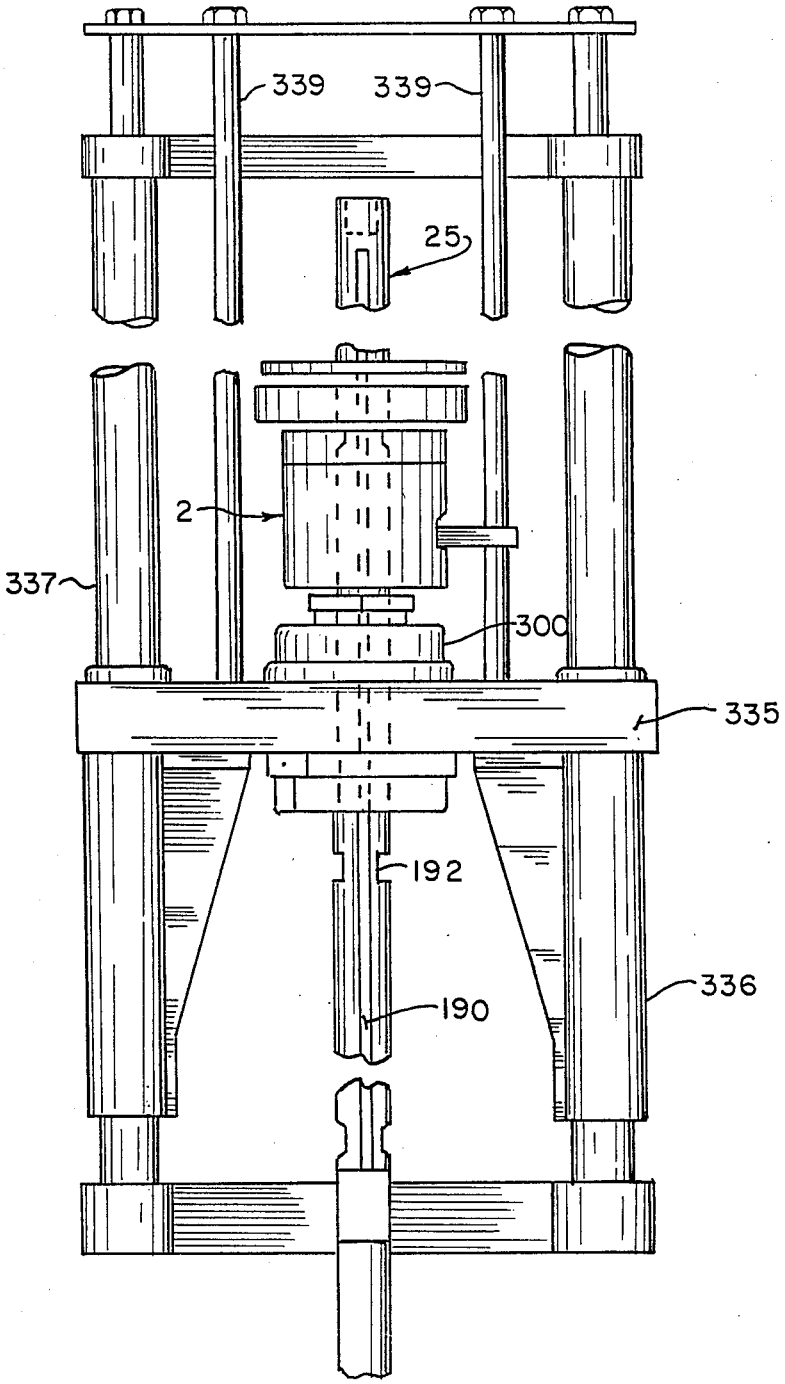
FIG. 10 is a view in front elevation, partly interrupted, of a kelly bar mounting and drive apparatus incorporating the hydraulic chuck of this invention.

Referring to FIG. 8, a valving system is shown that is used on the commercial drilling rig, but only that part of it which has to do with the operation of the chuck will be described. These include a source 200 of oil under pressure, a supply line 201 from the source 200 to a control valve 202 with a lever 203 by which the supply line 201 is connected to and disconnected from a port 204 connected by a line 205 to a pressure reducing valve 206, which is connected to the pressure line 185 connected to the passage 180 of the chuck. When the lever 203 is thrown to the position at which the fluid from the source 200 reaches the passage 180, the fluid, acting on the piston head wall 152 and then also the face of the spacer ledge 155, moves the plunger, against the bias of the spring 17, to a position clear of the shoulders 194 and 193 of the kelly bar. It will be seen that in the embodiment of kelly bar shown in FIG. 4, in which there is an undercut bottom lip, the plunger will retract with difficulty, if at all, when there is pressure being applied through the chuck to the kelly bar. However, that is not a practical problem, because the plungers are not retracted under those conditions. When the pressure is applied to the pistons, as has been indicated, the controlled leakage of the oil through the seals 36 and 37 lubricates, flushes and cools both the seals and the bearings 12 and 13. This occurs frequently, because the chuck is raised to the next kelly bar channel in the course of drilling, as the drill string is driven into the earth. In each case, the valve lever 203 is thrown into a position in which the oil in the lines 185 and 205 drain, in response to the bias of the spring 17, into a sump or reservoir, permitting the spring to drive the nose 148 into the next channel 192 of the kelly bar as the table is raised or lowered, depending upon whether the drill string is being lowered or raised.

Numerous variations in the construction of the device of this invention within the scope of the appended claims will occur to those skilled in the art in light of the foregoing disclosure. Merely by way of illustration, seals different from the Teflon-impregnated bronze seals 36 and 37 can be used, as long as they are capable of permitting flow through them, and different flow rates can be accomplished, as has been indicated above. The seals should be such as to permit flow at greater pressures, to minimize scoring of the revolving surface, in contradistinction to O-rings and lip seals, which tend to be forced more tightly into engagement with the rotating surfaces as the pressure is increased, which increases wear, and tends to promote the formation of grooves. In certain applications where a large flow is thought to be necessary or desirable, or can be tolerated, the sealing means may be provided simply by the restriction produced by close tolerances between facing surfaces of the body and housing or their equivalents, without separate seals. Different biasing means can be employed for the plungers, including double acting hydraulic connections, although the illustrative embodiment has advantages of simplicity and certainty in its operation. Different guide-orienting means can be used for the plungers, as, for example, fingers on the skirt projecting through holes in the cap, or flats on the skirt area and cylinder. The manifold channel can be provided in the inner wall of the boss 160 or the seal grooves 136 and 137 can be provided in the inner wall of the boss 160, or both. These are merely illustrative.

Having thus described the invention, what is claimed and desired to be secured by Letters Patent is:

1. In a rotary drilling apparatus wherein a rotary table is adapted to be moved axially while rotating, said rotary table including a spindle having an axially directed passage through its center of rotation, a kelly bar extending through said passage, means carried by the rotary table for transmitting positive rotational force from the rotary table to the kelly bar, said kelly bar having axially spaced upper and lower shoulder surfaces defining a plurality of axially spaced channels, elongated plunger means moveable radially with respect to said spindle passage carried by said rotary table, for selectively engaging and disengaging said kelly bar shoulder surfaces, actuating means for causing said plunger means to engage with and disengage from said shoulder surfaces, a tubular housing held against rotation but to permit axial movement of said housing with said table, the improvement comprising a chuck body connected to said spindle, said chuck body having an axial bore to receive said kelly bar and a radially extending cylinder cavity, in which said plunger means are mounted, said plunger means having a nose on a radially inner end, said nose selectively extending within said kelly bar channels for engaging said kelly bar shoulder surfaces, a cylindrically intermediate portion and an enlarged annular piston part radially outward of said intermediate portion, said cylinders in said body in which said plungers reciprocate having a configuration complementary to said plunger intermediate portion and said piston part to receive them closely but slidably, said housing having a fluid passage through it communicating with an annular manifold channel, and said body having fluid passages associated with each cylinder communicating at one end with said manifold channel and at another end with said cylinder radially inboard of said piston part.

2. The improvement of claim 1 including means for preventing rotation of said plungers.

3. The improvement of claim 2 wherein the said means for preventing rotation of said plunger comprise a cap, fixed on a radially outer end of said cylinder, and fingers, said fingers extending into blind passages in one of said plunger and cap.

4. The improvement of claim 3 wherein the passages are in said plunger and said fingers are integral with said cap.

5. The improvement of claim 1 wherein said nose has upper and lower chordal flats with leading edges parallel with one another and parallel with said kelly bar shoulders.

6. The improvement of claim 3 wherein said lower chordal flat is inclined downwardly in a direction toward said lower shoulder surface.

7. The improvement of claim 6 wherein the lower of each said kelly bar shoulders is sloped downwardly radially inwardly complementarily to said lower nose flat.

8. The improvement of claim 1 including means for continuously biasing said plungers radially inwardly.

9. The improvement of claim 8 wherein said biasing means comprise a helical compression spring.

10. The improvement of claim 9 including a disc with two radial faces one of the faces of which is seating against a bottom surface of a well in said plunger and the other face bears against an end of said spring, and a stem connected to said disc, said stem being journaled in a passage in a cap closing said cylinder whereby, when said plunger moves outwardly against the bias of the spring, the stem will protrude from said cap to provide a visual indication that the plunger has moved free of the kelly bar shoulders.

11. The improvement of claim 1 wherein oil under pressure is supplied to said fluid passages, hence to said manifold, said improvement including bearings extending circumferentially around said body, located between said body and said housing and spaced axially above and below said annular manifold channel, and annular seals above and below said manifold channel between said manifold channel and said bearings, said seals leaking sufficient of said oil under pressure to lubricate and cool said bearings.

12. The improvement of claim 11 including an axial passage in said housing communicating at its upper end with an upper area of said upper bearing and communicating at its lower end with a lower area of said lower bearing, and communicating with a drain line, whereby said oil leaking through said bearings is returned to a reservoir.

13. The improvement of claim 11 wherein the leakage is on the order of one-half gallon per minute.

14. In a rotary drilling apparatus wherein a rotary table is adapted to be moved axially while rotating, said rotary table including a spindle having an axially directed passage through its center of rotation, a kelly bar extending through said passage, means carried by the rotary table for transmitting positive rotational force from the rotary table to the kelly bar, said kelly bar having axially spaced upper and lower shoulder surfaces defining a plurality of axially spaced channels, a plurality of elongated plunger means moveable radially with respect to said spindle passage carried by said rotary table, for selectively engaging and disengaging said kelly bar shoulder surfaces, means for causing said plunger means to engage with and disengage from said shoulder surfaces, a tubular housing held against rotation but to permit axial movement of said housing with said table, the improvement comprising a chuck body connected to said spindle, said chuck body having an axial bore to receive said kelly bar and a plurality of radially extending cylinder cavities, in which said plunger means are mounted; each of said plunger means having a nose on a radially inner end, said nose having chordal flats, leading edges of which are parallel with shoulders defining channels in said kelly bar, and the lower of which nose flats is sloped downwardly toward a lower kelly bar shoulder to define a nose engaging said lower shoulder when said plunger is moved radially inwardly and the chuck is moved downwardly, said plunger having a cylindrically intermediate portion and an enlarged annular piston part radially outward of said intermediate portion, said cylinders in said body in which said plungers reciprocate having a configuration complementary to said plunger intermediate portion and said piston part to receive them closely but slidably; means for preventing rotation of said plunger means in said cylinders comprising a cap, fixed on a radially outer end of said cylinder, and fingers, said fingers extending into blind passages in one of said plunger and cap; plunger biasing means in the form of a helical spring mounted between said cap and said plunger; said housing having a fluid passage through it communicating with an annular manifold channel, and said body having fluid passages associated with each cylinder communicating at one end with said manifold channel and at another end with said cylinder radially inboard of said piston part; means for supplying oil under pressure to said fluid passages, hence to said manifold; bearings extending circumferentially around said body, located between said body and said housing and spaced axially above and below said annular manifold channel, and annular seals above and below said manifold channel between said manifold channel and said bearings, said seals leaking sufficient of said oil under pressure to lubricate and cool said seals and bearings; and indicating means, including a disc with two radial faces, one of the faces of which is seating against a bottom surface of a well in said plunger and the other face bears against an end of said helical spring, and a stem connected to said disc, said stem being journaled in a passage in said cap closing said cylinder whereby, when said plunger moves outwardly against the bias of the spring, the stem will protrude from said cap to provide a visual indication that the plunger has moved free of the kelly bar shoulders.

* * * * *